US005361589A

United States Patent [19]

Howard et al.

[11] Patent Number: 5,361,589

[45] Date of Patent: Nov. 8, 1994

[54] PRECOOLING FOR ETHYLENE RECOVERY IN DUAL DEMETHANIZER FRACTIONATION SYSTEMS

[75] Inventors: Lee J. Howard, Allentown; Howard C. Rowles, Center Valley, both of Pa.

[73] Assignee: Air Products and Chemicals, Inc., Allentown, Pa.

[21] Appl. No.: 191,683

[22] Filed: Feb. 4, 1994

[51] Int. Cl.[5] ..... F25J 3/02

[52] U.S. Cl. ..... 62/24; 62/31; 62/43

[58] Field of Search ..... 62/23, 24, 38, 39, 31, 62/43

[56] References Cited

U.S. PATENT DOCUMENTS

| | | | |
|---|---|---|---|
| 3,675,435 | 7/1972 | Jackson et al. | 62/26 |
| 4,002,042 | 1/1977 | Pryor et al. | 62/28 |
| 4,163,652 | 8/1979 | Gazzi et al. | 62/28 |
| 4,629,484 | 12/1986 | Kister | 62/29 |
| 4,657,571 | 4/1987 | Gazzi | 62/23 |
| 4,900,347 | 2/1990 | McCue, Jr. et al. | 62/24 |
| 5,035,732 | 7/1991 | McCue, Jr. | 62/24 |

*Primary Examiner*—Ronald C. Capossela

*Attorney, Agent, or Firm*—John M. Fernbacher; James C. Simmons; William F. Marsh

[57] ABSTRACT

Ethylene-containing feed gas to a cryogenic ethylene recovery system is cooled and condensed, prior to fractionation, by an improved method which utilizes a combination of one or more partial condensers followed by one or more dephlegmators. The improved method simplifies heat exchange equipment and reduces capital cost, and is particularly suited for processing a pressurized precooled feed gas from ethane cracking which contains less than about 1 mole % of propane plus propylene.

10 Claims, 1 Drawing Sheet

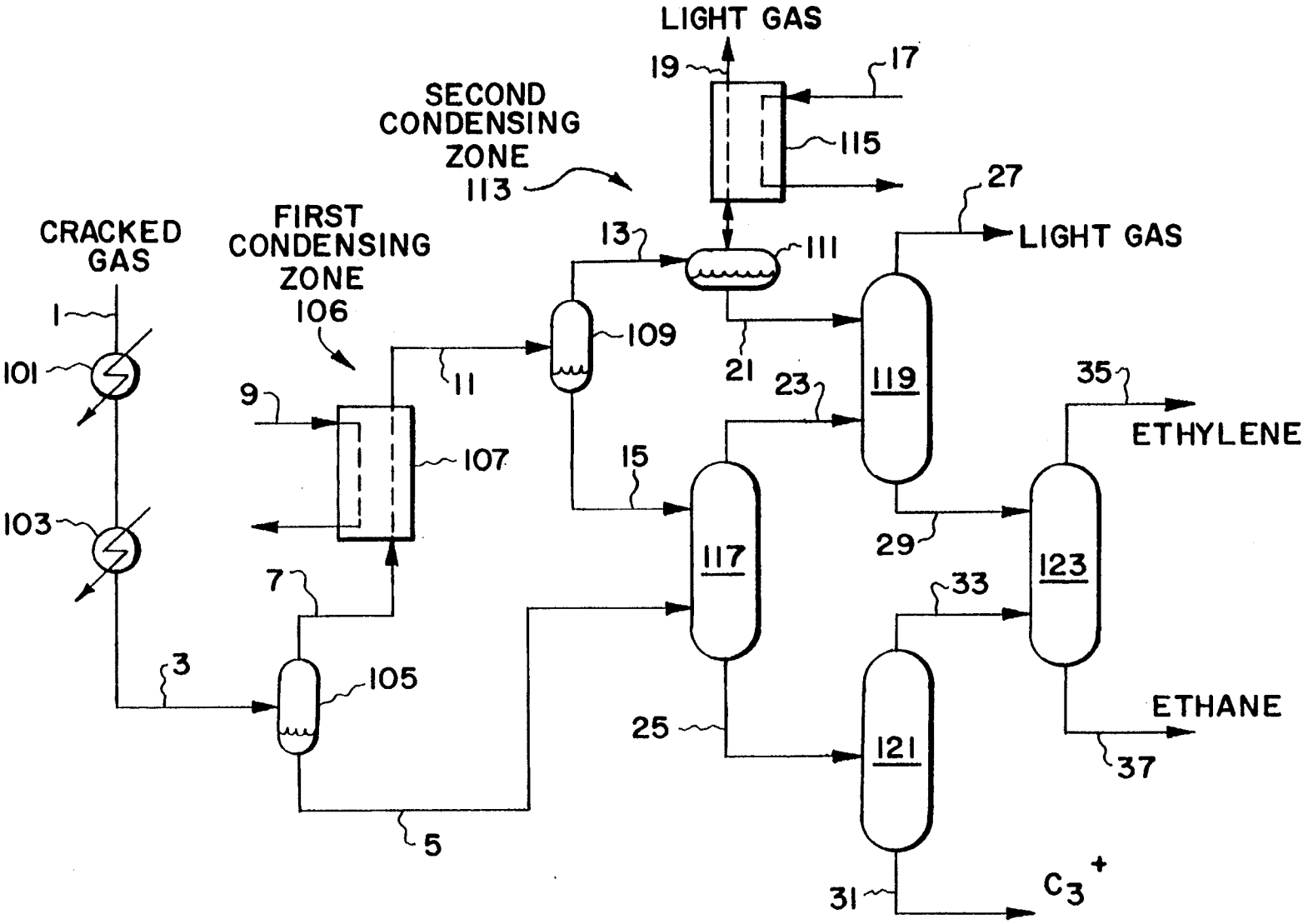
CRACKED GAS
1
101
103
3
FIRST CONDENSING ZONE 106
9
107
105
7
5
11
SECOND CONDENSING ZONE 113
13
109
15
117
25
LIGHT GAS
19
17
115
111
21
23
119
29
27
LIGHT GAS
121
33
31
$C_3^+$
123
35
ETHYLENE
37
ETHANE

PRECOOLING FOR ETHYLENE RECOVERY IN DUAL DEMETHANIZER FRACTIONATION SYSTEMS

FIELD OF THE INVENTION

This invention pertains to the recovery of ethylene from light gases at low temperature, and in particular to an improved method for precooling the feed to a dual demethanizer cryogenic fractionation section of an ethylene recovery system.

BACKGROUND OF THE INVENTION

The recovery of ethylene from crude light hydrocarbon gas mixtures is an economically important but highly energy intensive process. Cryogenic separation methods are commonly used which require large amounts of refrigeration at low temperatures, and the continuing development of methods to reduce refrigeration power is important for olefin recovery in the petrochemical industry.

Ethylene is recovered from light gas mixtures such as cracked gas from hydrocarbon crackers which contain various concentrations of hydrogen, methane, ethane, ethylene, propane, propylene, and minor amounts of higher hydrocarbons, nitrogen, and other trace components. Refrigeration for condensing and fractionating such mixtures is commonly provided at successively lower temperature levels by ambient cooling water, closed cycle propane/propylene and ethane/ethylene systems, and work expansion or Joule-Thomson expansion of pressurized light gases produced in the separation process. Numerous designs have been developed over the years using these types of refrigeration as characterized in representative U.S. Pat. Nos. 3,675,435, 4,002,042, 4,163,652, 4,629,484, 4,900,347, and 5,035,732.

An improvement to the cryogenic separation methods described above is disclosed in U.S. Pat. No. 4,002,042 wherein the final cooling and condensing of the feed gas between about −75° F. and −175° F. is performed in a dephlegmator type heat exchanger. This provides a much higher degree of prefractionation as the ethylene-containing liquids are condensed from the cold feed gas, since the dephlegmator can provide 5 to 15 or more stages of separation compared to the single stage of separation provided by a partial condenser type of heat exchanger. As a result, significantly less methane is condensed from the feed gas and sent to the demethanizer column and refrigeration energy requirements for both feed cooling and demethanizer column refluxing are reduced. This improved process combines a dephlegmator with a demethanizer column to achieve energy savings in both the cryogenic separation and cold fractionation sections of the ethylene plant.

Further improvements to the cryogenic separation and cold fractionation sections of the conventional process are described in U.S. Pat. 4,900,347. In these improvements, all feed gas cooling for ethylene recovery below about −30° F. is carried out in a series of at least two dephlegmators, for example, a warm dephlegmator and a cold dephlegmator, and the demethanizer column is split into a first (warm) demethanizer column and a second (cold) demethanizer column, both operating at high pressure. Some feed cooling above −30° F. may also be done in a dephlegmator. The warm dephlegmator condenses and prefractionates essentially all of the propylene and heavier hydrocarbons remaining in the −30° F. feed gas along with most of the ethane and this liquid is sent to the warm demethanizer column. Reflux for the warm demethanizer column is typically provided by condensing a portion of the overhead vapor using propylene or propane refrigeration at −40° F. or above. The bottom liquid from the warm demethanizer column is sent to the de-ethanizer column where the $C_3$ and heavier hydrocarbons ($C_3$+) are recovered as a bottom product. The $C_2$ hydrocarbon overhead from the de-ethanizer column is sent to the ethylene/ethane splitter column. The cold dephlegmator condenses and prefractionates the remaining ethylene and ethane in the cold feed gas and this liquid is sent to the cold demethanizer column. Reflux for the cold demethanizer column is typically provided by condensing a portion of the overhead vapor using ethylene refrigeration at about −150° F. The ethylene-rich bottom liquid from the cold demethanizer column contains essentially no propylene or propane and is sent directly to the ethylene/ethane splitter column as a second feed, thus bypassing the de-ethanizer column.

U.S. Pat. No. 5,035,732 describes a variation of the process described above wherein the second (cold) demethanizer column is operated at low pressure conditions, 175 psia or less. Reflux for the low pressure cold demethanizer column is provided by condensing a portion of the cold demethanizer column overhead vapor or the cold dephlegmator overhead vapor, using expander and/or other process stream refrigeration below −150° F.

The improved processes of U.S. Pat. Nos. 4,900,347 and 5,035,732 combine multiple dephlegmators with a multi-zone demethanizer column system to achieve energy savings in the cryogenic separation section of the ethylene plant, and to achieve both capital and energy savings in the cold fractionation section of the ethylene plant. Compared to the conventional process:

1) the dephlegmators require less refrigeration energy than conventional partial condenser type heat exchangers because significantly less methane is condensed;
2) the multi-zone demethanizer column system is cheaper than the conventional single-column demethanizer system because the warm column utilizes less expensive materials and the cold column, which uses more expensive materials, is smaller than the conventional single-column (cold) demethanizer;
3) the multi-zone demethanizer column system requires less refrigeration energy for refluxing because less methane is condensed and sent to the columns and also because the warm column utilizes warmer, low energy intensive refrigeration and the cold column uses less cold, high energy intensive refrigeration than the conventional single-column (cold) demethanizer;
4) the de-ethanizer column is smaller and requires less separation energy due to the smaller quantity of liquid which must be processed in the column; and
5) the ethylene/ethane splitter column is smaller and requires less separation energy due to the preseparation provided by the two feed streams to the column.

The improved processes described in U.S. Pat. Nos. 4,002,042, 4,900,347 and 5,035,732 can be used to recover ethylene from feed gas produced by cracking of ethane, ethane/propane, or heavier hydrocarbons such as LPG, naphtha or gas oil.

Thus the use of a multi-zone demethanizer system is an efficient and preferred mode of operation for recovering ethylene from ethylene-containing feed gases. Further improvements to such a system are desirable, and such improvements are realized for ethylene-containing feed gases from ethane and ethane-propane cracking by the invention described in the following specification and defined by the appended claims.

SUMMARY OF THE INVENTION

The present invention is an improved method for precooling and condensing the pressurized feed gas to an ethylene recovery process. A known process for the recovery of ethylene from a pressurized feed gas containing ethylene, hydrogen, and $C_1$ to $C_3$ hydrocarbons includes the steps of precooling and partially condensing the pressurized feed gas, fractionating the condensed feed gas in a first demethanizer zone to yield an intermediate vapor and a first demethanizer liquid enriched in $C_2$+hydrocarbons, fractionating the intermediate vapor in a second demethanizer zone to yield a light overhead product and a second demethanizer liquid enriched in $C_2$ hydrocarbons, and fractionating the first and second demethanizer liquids to recover an ethylene product and streams containing ethane and $C_3$+hydrocarbons. The improved method of the present invention for precooling and condensing the pressurized feed gas comprises initially cooling and partially condensing the pressurized feed gas in a partial condenser in a first condensing zone which operates at or above a characteristic temperature. The partially condensed feed gas is separated into a first vapor stream and a condensed liquid, and the first vapor stream is cooled, partially condensed, and rectified by dephlegmation in a second condensing zone which operates below the characteristic temperature to yield a light gas product and a dephlegmator liquid. The condensed liquid provides feed to the first demethanizer zone and the dephlegmator liquid provides feed to the second demethanizer zone. The characteristic temperature is between about −80° F. and about −120° F. The pressurized feed gas preferably contains less than about 1mole % propane plus propylene and less than about 25 mole % methane.

Equipment simplification and capital savings are realized by the feed condensing method of the present invention while maintaining the energy efficiency advantages and other capital savings provided by the prior art system which utilizes multiple dephlegmators and two demethanizers.

BRIEF SUMMARY OF THE DRAWING

The single FIGURE is a schematic flowsheet showing the improved feed precooling and condensing method of the present invention.

DETAILED DESCRIPTION OF THE INVENTION

In ethylene plants based on propane or heavier hydrocarbon cracking, the cracked gas feed to the cryogenic separation section (or chilling train) is typically at about −20° F. to −40° F., about 350 to 550 psia and contains about 25 to 45 mole % methane, 25 to 45 mole % ethylene/ethane and 2 mole % or more of propylene/propane and heavier hydrocarbons, along with hydrogen and other light gases. In the improved cryogenic separation and cold fractionation process described in earlier-cited U.S. Pat. Nos. 4,900,347 and 5,035,732, a "warm" dephlegmator is necessary in the first condensing zone with this type of cracked gas feed in order to minimize the quantity of methane which is condensed and sent to the two demethanizer columns, and also to reduce the amount of propylene and propane entering the "cold" dephlegmator in the second condensing zone to less than about 0.05 mole %. As a result, ethylene and ethane recovered in the cold dephlegmator does not pass through the de-ethanizer column.

However, in ethylene plants based on ethane cracking, or in some cases ethane/propane cracking, the cracked gas feed to the cryogenic separation section at −20° F. to −40° F. and 35 to 550 psia typically contains only 5 to 20 mole % methane and less than about 1 mole % of propylene/propane and heavier hydrocarbons. With this type of cracked gas feed, it has been found in the present invention that the "warm" dephlegmator in the first condensing zone of the cryogenic separation section according to earlier-cited U.S. Pat. Nos. 4,900,347 and 5,035,732 can be replaced with one or more partial condensers to cool the feed to about −80° F. to −120° F. With this type of cracked gas feed, the partial condenser(s) can reduce the concentration of propylene plus propane entering the second condensing zone (cold) dephlegmator to less than about 0.05 mole % without increasing the quantity of condensed methane sufficiently to incur a significant penalty in the demethanizer columns. Therefore, the ethylene and ethane recovered in the cold dephlegmator does not have to pass through the de-ethanizer column. In ethane/propane cracking, the amount of methane in the cracked gas feed depends in large part on the fraction of propane which is cracked relative to the ethane which is cracked.

A dephlegmator is a rectifying heat exchanger which partially condenses and rectifies the feed gas. Typically a dephlegmator yields a degree of separation equivalent to multiple separation stages, typically 5 to 15 stages. A partial condenser is defined herein as a conventional condenser in which a feed gas is partially condensed without rectification to yield a vapor-liquid mixture which is separated into vapor and liquid streams in a simple separator vessel. A single stage of separation is realized in a partial condenser.

The concept of the present invention also can be used in some ethylene plants which utilize a front-end de-ethanizer column (upstream of the cryogenic separation section), since the cracked gas feed entering the cryogenic separation section would then typically contain less than about 1 mole % propylene plus propane. In addition, the amount of methane in the cracked gas feed entering the cryogenic separation section preferably should be less than about 25 mole% and more preferably less than about 15 mole % in order to minimize the quantity of methane which is condensed in the partial condenser(s) of the first condensing zone and sent to the warm demethanizer column. In this case, the amount of methane in the cracked gas feed is dependent on the specific cracker feedstock.

The invention is described in detail with reference to the single FIGURE, in which cracked gas 1 is compressed to about 350 to 550 psia (not shown) and cooled to about −20° to −40° F. in coolers 101 and 103 using conventional propane or propylene refrigeration. Stream 3, now partially condensed, passes into separator 105 from which condensate 5 and vapor 7 are withdrawn.

Vapor 7 is the pressurized feed gas of the present invention as defined in the appended claims, and typically contains 30 to 60 mole % hydrogen, 5 to 30 mole % methane, 10 to 40 mole % ethylene, and 5 to 20 mole % ethane. Vapor 7 preferably contains less than about 1 mole % $C_3$ and heavier hydrocarbons, preferably contains less than 25 mole % methane, and is typically obtained by the thermal cracking of ethane or ethane/propane. Vapor 7 is further cooled and partially condensed in first condensing zone 106 by indirect heat exchange with refrigerant 9 supplied at between about −25° F. and −125° F. Refrigerant 9 typically comprises one or more levels of ethylene refrigerant or a mixed refrigerant, and may be supplemented by cold streams produced in the ethylene plant. Heat exchanger 107 is a conventional heat exchanger of the shell and tube or brazed aluminum type. Mixed vapor/condensate stream 11 at between about −80° F. and −120° F. passes to separator 109 from which vapor 13 and liquid 15 are withdrawn. Heat exchanger 107 and separator 109 of first condensing zone 106 operate as a partial condenser system which provides the equivalent of a single stage of separation in which vapor 13 and liquid 15 are in approximate thermodynamic equilibrium.

Vapor 13, which typically contains 50 to 80 mole % hydrogen, 10 to 35 mole % methane, 5 to 20 mole % ethylene, less than 10 mole % ethane and less than 0.1 mole % propylene/propane, passes to accumulator drum 111, and is further cooled in dephlegmator 115 to simultaneously condense and rectify vapor 13 in second condensing zone 113. Typically, dephlegmator 115 provides 5 to 15 stages of separation, in contrast with the partial condenser system consisting of heat exchanger 107 and separator 109 which provide only one stage of separation. Dephlegmator 115 is cooled by refrigerant 17 supplied at between about −85° F. and −235° F. Refrigerant 17 typically comprises one or more levels of ethylene refrigerant along with various cold streams produced in the ethylene plant, or a mixed refrigerant. Light gas 19 comprising chiefly methane and hydrogen is withdrawn from dephlegmator 115 and a portion thereof typically passes to the hydrogen recovery section of the ethylene plant (not shown). Dephlegmator liquid 21 is withdrawn at about −85° F. to −130° F. and typically contains 5 to 15 mole % methane, 60 to 80 mole % ethylene, 15 to 30 mole % ethane and less than 0.5 mole % propylene plus propane.

Liquid streams 5 and 15 contain essentially all the propane, propylene, and heavier hydrocarbons and a large fraction of the ethane contained in cracked gas stream 1. These streams provide feeds to first demethanizer zone 117 which includes a distillation column, overhead condenser system, and additional operating features known in the art. First demethanizer zone 117 typically operates in the temperature range of +60° F. to −40° F. and yields overhead vapor 23 which contains essentially all the hydrogen and methane and a large fraction of the ethylene from the feedstreams 5 and 15. Bottoms liquid 25 is withdrawn therefrom and contains essentially all the propane, propylene, and heavier hydrocarbons and a large fraction of the ethane from the feedstreams 5 and 15. Bottoms liquid 25 is introduced into de-ethanizer column 121 and bottoms stream 31 containing essentially all propane, propylene, and heavier hydrocarbons is withdrawn therefrom. Withdrawn overhead vapor 33 contains essentially all the ethane and ethylene in first demethanizer zone bottoms liquid 25.

Second demethanizer zone 119, which typically operates in the temperature range of +25° F. to −230° F., is fed at two locations by dephlegmator liquid 21 and first demethanizer zone overhead vapor 23 respectively. Hydrogen-methane overhead vapor 27 and ethylene-rich bottoms liquid 29 are withdrawn therefrom. Final cold fractionation is accomplished in ethane-ethylene splitter column 123 to yield high purity ethylene product 35 and ethane bottom product 37.

EXAMPLE

Mass and energy balances were carried out to illustrate the invention according to the single FIGURE. Cracked gas stream 1 is cooled to −26° F. utilizing several levels of $C_3$ refrigerant in coolers 101 and 103. This yields cooled and partially condensed stream 3, which is separated in vessel 105 at −26° F. and 508 psia into condensate 5 (predominantly propylene/propane and heavier hydrocarbons) and vapor 7. Condensate 5 provides feed to first (warm) demethanizer zone 117. Vapor 7 is the pressurized feed gas of the present invention as defined in the appended claims, and in this Example contains 43 mole % hydrogen, 11 mole % methane, 29.5 mole % ethylene, 16 mole % ethane and 0.5 mole % propylene plus propane. Vapor 7 is cooled to −98° F. in partial condenser type heat exchanger 107 to yield two-phase stream 11, which is separated in vessel 109 into condensate 15 and vapor 13. Condensate 15 containing about 55.5 mole % ethylene, 34 mole % ethane and 7.5 mole % methane provides another feed to first demethanizer zone 117. Vapor stream 13 at −98° F., containing about 72.5 mole % hydrogen, 13.5 mole % methane, 10.5 mole % ethylene, 3.5 mole % ethane and less than 0.02 mole % propylene plus propane, is cooled to −216° F. in dephlegmator 115 of second condensing zone 113 to condense and prefractionate the remaining ethylene and ethane. Ethylene-rich liquid 21 at −105° F., recovered from dephlegmator drum 111, containing about 67.5 mole % ethylene, 22.5 mole % ethane and 8 mole % methane, provides feed to the second (cold) demethanizer zone 119.

The two liquid streams 5 and 15, which contain essentially all of the propylene, propane, and heavier hydrocarbons and more than 85% of the ethane condensed from cracked gas 1, are processed in warm demethanizer zone 117 to reject all of the hydrogen, methane and other light gases in first demethanizer overhead 23 which also contains a portion of the ethylene and ethane which entered the first demethanizer. The remaining ethylene and ethane, and all of the propylene, propane and heavier hydrocarbons are removed in the bottom stream 25, and sent to de-ethanizer column 121. The ethylene-rich liquid recovered from dephlegmator 115 as stream 21, and the ethylene-enriched overhead vapor stream 23 from warm demethanizer zone 117 are processed in second demethanizer zone 119 to reject all of the hydrogen, methane and other light gases in overhead stream 27.

Ethylene-rich stream 29 from the bottom of second demethanizer zone 119 and ethylene/ethane stream 33 from the overhead of de-ethanizer column 121 are fractionated in ethylene/ethane splitter column 123 to produce ethylene product stream 35 and bottom ethane stream 37, which is usually recycled to the cracking furnaces. All of the fractionators 117, 119, 121, and 123 shown in FIG. 1 are normally operated with conventional reboilers and overhead condensers, which are not shown for simplicity.

Two or more partial condensers can be utilized in series in first condensing zone 106 of the cryogenic separation section to cool the pressurized feed gas to about −80° F. to −120° F., for example, to utilize several temperature levels of ethylene or other refrigerant in separate heat exchangers as a matter of convenience. Alternatively, if a mixed refrigerant were used, a single partial condenser would be preferable. Similarly, two or more dephlegmators could be utilized in series in the second condensing zone 113 to cool the feed gas below about −80° F. to −120° F. to provide further increased prefractionation of the condensed ethylene liquid or for convenience in utilizing various refrigerant streams.

Other variations within the cryogenic separation section are also possible in order to increase the energy efficiency of the process, such as heat exchanging or contacting between dephlegmator liquid stream 21 and first demethanizer zone overhead vapor stream 23, and/or refrigeration recovery (rewarming) from the condensed liquid streams 5 and/or 15. Second demethanizer zone overhead vapor stream 27 can also be cooled in a dephlegmator to recover residual ethylene from that light gas.

Typically at least a portion of hydrogen-methane light gas stream 19 from the overhead of dephlegmator 115 is sent to a hydrogen recovery section to produce a high purity hydrogen product and one or more methane-rich fuel streams which are rewarmed in the cryogenic separation section heat exchangers for refrigeration recovery. Also, at least a portion of the hydrogen-methane light gas stream 27 from the overhead of second demethanizer zone 119 and the remaining portion of the hydrogen-methane stream 19 from the overhead of dephlegmator 115 typically are sent to one or more expanders to provide refrigeration below −150° F. in the cryogenic separation section and optionally in the cold fractionation section of the process.

The combination partial condenser and dephlegmator process of the present invention maintains essentially all of the energy and capital savings of the prior art all-dephlegmator, multi-zone demethanizer improved process described in U.S. Pat. Nos. 4,900,347 and 5,035,732, and in addition provides a significant equipment simplification and capital savings. The "warm" dephlegmator required in the first condensing zone of these prior art processes typically consists of 4 to 16 heat exchange units in parallel in order to provide sufficient cross-sectional flow area for the counter-current vapor/liquid feed flow in the dephlegmators. The partial condenser used in the present invention in place of the prior art warm dephlegmator typically requires less than half the cross-sectional flow area, and therefore less than half of the number of parallel units, because the co-current vapor/liquid feed flow in the partial condenser allows a much higher feed gas flow velocity than in the counter-current flow dephlegmator. A significant capital savings thus is realized in the present invention by reducing the number of parallel heat exchange units and associated piping compared with the warm dephlegmator of the prior art process. Dephlegmator 115 in the second condensing zone 113 of the present invention will be essentially the same as the "cold" dephlegmator in the prior art all-dephlegmator process. The reduced quantity of the lowest and most energy intensive levels of refrigeration realized in the prior art multi-dephlegmator process is maintained with the process of the present invention. In the prior art process, the "cold" dephlegmator typically consists of about half as many parallel heat exchange units as the "warm" dephlegmator due to the much lower feed gas flow rate, and therefore represents a much lower capital cost than the warm dephlegmator. Replacement of the prior art "warm" dephlegmator by the partial condenser of the present invention therefore offers a simplified and much less expensive feed cooling system.

In the Example described above, the total amount of methane condensed from the cracked gas feed using the combination partial condenser/dephlegmator process of the present invention is increased by about 50% as compared to the prior art all-dephlegmator improved process, but the total amount of liquids condensed from the feed is increased by only about 3%. The total amount of liquids processed in the two demethanizer zones is therefore increased by only about 3% and there is essentially no change in the amount of liquids processed in the de-ethanizer and ethylene/ethane splitter columns. The difference in energy requirements for ethylene separation and fractionation between the present invention and the prior art all-dephlegmator process is therefore very small, and the difference in equipment cost in the cold fractionation section (first and second demethanizers, de-ethanizer and ethane/ethylene splitter columns) is insignificant. Therefore, the reduction in the number of parallel heat exchange units required for feed gas cooling and condensing using the partial condenser/dephlegmator process of the present invention provides a significant capital savings over the prior art all-dephlegmator process.

Critical requirements of the present invention include that (1) all feed gas cooling and condensing which occur at or above a characteristic temperature to provide liquids to the warm demethanizer zone should be carried out in a condensing zone utilizing one or more partial condensers, and (2) all feed gas cooling and condensing which occur below this characteristic temperature to provide liquids to the cold demethanizer zone should be done in a condensing zone utilizing one or more dephlegmators. This characteristic temperature is in the range of about −80° F. to about −120° F. and is determined by the pressure and concentrations of methane and $C_3$+hydrocarbons in the pressurized feed gas defined as vapor 7.

Another critical requirement of the present invention is that the feed gas to the cryogenic separation section of the ethylene plant, i.e. the pressurized feed gas defined as vapor 7, should preferably contain less than about 1 mole % propylene plus propane, and more preferably less than about 0.5 mole % propylene plus propane, so that the partial condenser type heat exchanger(s) in first condensing zone 106 can reduce the amount of propylene and propane entering the second condensing zone 113 dephlegmator(s) to less than about 0.05 mole %. This is desirable so that the ethylene and ethane recovered in the dephlegmator(s) need not be processed in the de-ethanizer column.

An additional critical requirement of the process of the present invention is that the pressurized feed gas defined as vapor 7 to the cryogenic separation section of the ethylene plant should preferably contain less than about 25 mole % methane, and more preferably less than about 15 mole % methane, in order to minimize the quantity of methane which is condensed in the partial condenser(s) of first condensing zone 106 and sent to the warm demethanizer zone as stream 15.

These requirements are necessary to fully realize the additional equipment simplification and capital savings provided by the present invention without losing the energy efficiency advantages and other capital savings provided by the prior art all-dephlegmator/multi-demethanizer system.

The essential characteristics of the present invention are described completely in the foregoing disclosure. One skilled in the art can understand the invention and make various modifications thereto without departing from the basic spirit thereof, and without departing from the scope of the claims which follow.

We claim:

1. In a process for the recovery of ethylene from a pressurized feed gas containing ethylene, hydrogen, and $C_1$ to $C_3$ hydrocarbons, wherein said recovery includes the steps of precooling and partially condensing said pressurized feed gas, fractionating the condensed feed gas in a first demethanizer zone to yield an intermediate vapor and a first demethanizer liquid enriched in $C_2$+hydrocarbons, fractionating said intermediate vapor in a second demethanizer zone to yield a light overhead product and a second demethanizer liquid enriched in $C_2$ hydrocarbons, and fractionating said first and second demethanizer liquids to recover an ethylene product and streams containing ethane and $C_3$+hydrocarbons, an improved method for precooling and condensing said pressurized feed gas which comprises in combination:

(a) cooling and partially condensing said pressurized feed gas in a partial condenser in a first condensing zone which operates at or above a characteristic temperature;

(b) separating the partially condensed feed gas of step (a) into a first vapor stream and a condensed liquid; and (c) cooling, partially condensing, and rectifying said first vapor stream by dephlegmation in a second condensing zone which operates below said characteristic temperature to yield a light gas product and a dephlegmator liquid;

wherein said condensed liquid provides feed to said first demethanizer zone and said dephlegmator liquid provides feed to said second demethanizer zone.

2. The method of claim 1 wherein said characteristic temperature is between about −80° F. and about −120° F.

3. The method of claim 1 wherein said pressurized feed gas contains less than about 1 mole % propane plus propylene.

4. The method of claim 1 wherein said pressurized feed gas contains less than about 0.5 mole % propane plus propylene.

5. The method of claim 1 wherein said pressurized feed gas contains less than about 25 mole % methane.

6. The method of claim 1 wherein said pressurized feed gas contains less than about 15 mole % methane.

7. The method of claim 1 wherein said pressurized feed gas is obtained by the thermal cracking of ethane.

8. The method of claim 1 wherein said pressurized feed gas is obtained by the thermal cracking of ethane and propane.

9. The method of claim 1 wherein said pressurized feed gas is obtained from the overhead of a de-ethanizer column.

10. The method of claim 1 wherein said first vapor stream to said second condensing zone contains less than about 0.05 mole % propane plus propylene.

* * * * *